US012557929B2

(12) United States Patent
Garczynski

(10) Patent No.: US 12,557,929 B2
(45) Date of Patent: Feb. 24, 2026

(54) SYSTEM FOR ELECTRICITY-FREE COUTURE AIR DRYING OVER RIGID ARMS

(71) Applicant: Jack Garczynski, Greenfield, WI (US)

(72) Inventor: Jack Garczynski, Greenfield, WI (US)

( * ) Notice: Subject to any disclaimer, the term of this patent is extended or adjusted under 35 U.S.C. 154(b) by 828 days.

(21) Appl. No.: 17/533,099

(22) Filed: Nov. 22, 2021

(65) Prior Publication Data

US 2022/0160156 A1 May 26, 2022

Related U.S. Application Data

(60) Provisional application No. 63/116,913, filed on Nov. 22, 2020.

(51) Int. Cl.

| | |
|---|---|
| ***A47G 25/40*** | (2006.01) |
| ***A47G 25/14*** | (2006.01) |
| ***A47G 25/48*** | (2006.01) |
| ***D06F 57/12*** | (2006.01) |

(52) U.S. Cl.

CPC ..... *A47G 25/4023* (2013.01); *A47G 25/145* (2013.01); *A47G 25/482* (2013.01); *D06F 57/12* (2013.01)

(58) Field of Classification Search

CPC ..... A47G 25/4023; A47G 25/145; A47G 25/482; A47G 25/183; A47G 25/38; A47G 25/4046; D06F 57/12

See application file for complete search history.

(56) References Cited

U.S. PATENT DOCUMENTS

| | | | | |
|---|---|---|---|---|
| 2,716,513 A * | 8/1955 | Braunstein | ..... | A47G 25/4023 223/94 |
| 3,858,770 A * | 1/1975 | Murray | ..... | A47G 25/4023 223/94 |
| 2010/0025439 A1* | 2/2010 | Diamond | ..... | A47G 25/1442 223/88 |
| 2020/0383397 A1* | 12/2020 | Bean | ..... | A47G 25/14 |

* cited by examiner

*Primary Examiner* — Jessica Yuen

(74) *Attorney, Agent, or Firm* — Jeanette M. Braun, Esq.; Braun IP Law, LLC

(57) ABSTRACT

A device and system for a simplified electricity-free drying hanger system for air drying clothes, garments, fabric or other items. The arms of the hanger are removable and can be stored in a vertical orientation when not in use. The hanging support can swivel and allow the arms to be oriented an angle to the vertical axis. A hub can be configured to receive, secure, and rapidly disengage at least two separation arms both during storage or active use, and may connect further self-storing with accessories. A plurality of electricity-free drying hangers may nest by hanging the mounting swiveling rod on a nesting support structure that sprouts from the hub and create a cascade of hangers.

17 Claims, 11 Drawing Sheets

SYSTEM FOR ELECTRICITY-FREE COUTURE AIR DRYING OVER RIGID ARMS

CROSS-REFERENCE TO RELATED APPLICATION

This application claims priority benefit from U.S. Application 63/116,913 filed Nov. 22, 2020, which is incorporated by reference in its entirety.

FIELD OF THE DISCLOSURE

The present disclosure relates to the field of equipment and systems for non-electric air drying of clothing, and more specifically, to a system and apparatus that addresses wrinkling and deformation of valuable and often delicate clothing during air drying.

BACKGROUND OF THE DISCLOSURE

People have washed and dried clothing since not long after clothing was invented. The wash and dry process can be laborious, tedious, space consuming, damaging to clothing, environmentally taxing, and even expensive.

There is a global demand for technology that can balance reducing human labor with protecting clothing life and appearance. Technologies that involve less time and human labor are often harsher on clothing, leading to premature wear. The process of drying clothing with mechanical agitation and forced air heat saves time and human labor, but is notoriously known to shrink, fade, and damage fabric. For expensive couture clothing, this damage is unacceptable.

Further, mechanical drying requires that the consumer can afford to purchase a device, has room to store and use the device, as well as has a steady power source for the device. Globally, many consumers do not have these luxuries. Air drying is the main alternative, but has similar encumbrances. Space and time are required for air drying.

Air drying generally takes two forms—vertical and horizontal. Vertical drying generally requires less space and promotes air flow, but use of drying racks, traditional clothing hangers, clothespins with line, or similar often do not properly support the garment while it is drying. Uneven support of wet fabric as it dries leads to undesirable stretching and warping. Sometimes this can be remedied if the user checks on the clothing often and physically moves the clothing. Horizontal drying can help ensure wet clothing does not excessively sag, warp, or stretch due to the effects of gravity. Unfortunately, the space required for horizontal drying can be prohibitive. If the flat space is too small for the garment resulting in portions of the garment overhanging the support, then sag can occur, just as with vertical drying. Further with horizontal drying, the consumer may have to flip, rotate, or adjust the clothing to ensure it dries in a timely manner. With either method of vertical or horizontal air drying, the clothing can deform or have issues without user intervention. Especially for expensive couture clothing, this deformation and fussiness is unacceptable.

There is also a global demand for technology that can reduce carbon dioxide emissions. An electric clothes dryer typically consumes more electricity than other household appliances. Propane and natural gas clothes dryers are slightly more efficient, but still contribute heavily to total household carbon dioxide emissions. For example, as of 2010, 8.3% of carbon dioxide emissions in the United States were estimated as attributable to consumer laundry practices. Jay S. Golden, et. al. Energy and carbon impact from residential laundry in the United States, Journal of Integrative Environmental Sciences, 7:1, 53-73, DOI: 10.1080/19438150903541873 (2010). Air drying clothing is promoted as a method for consumers to reduce their carbon footprint.

U.S. Pat. No. 8,177,106B2 granted to Betts in 2012 for ADJUSTABLE GARMENT/COAT hanger discloses an adjustable garment hanger including an overhead suspension element and a pair of hanger arms extending outwardly from a central housing. Arm inclination is adjustable relative to fabric being supported so as to minimize wrinkling and deformation. Arms may collapse immediately downwardly on pivots to a generally vertical mode releasing the garment via its neckline opening.

U.S. Pat. No. 5,950,882 granted to Scott in 1999 for HANGING GARMENT DRYER discloses a mount which is connected to a door or wall which then receives a proprietary and reconfigurable collapsible hanger assembly to facilitate wrinkle free and expedited drying of clothing. This device meets the articulated needs of: self-storing components when not in use, as well as efficiently consuming space during both use and storage. This device, however, can damage clothing.

There remains a need for non-electric air drying of clothing apparatus and method that does not damage clothing.

SUMMARY OF THE DISCLOSURE

Many devices have attempted to address the nuanced issues associated with balancing the reduction of human labor with protecting clothing life and appearance when air drying clothing. Thus far, no known device meets all of the following needs: expediates air-drying of clothing, minimizes damage and deformation to fabric, consumes space efficiently when in use, consumes space efficiently when not in use, is self-contained both in use or storage to prevent components from being lost, is versatilely mountable to be movable, is able to nest additional units of the same or similar devices, and being quick and easy to use thus saving time.

The present disclosure proposes a solution that addresses all the encumbrances discussed. The disclosure is a self-contained, modular, and reconfigurable System for Electricity-Free Couture Air Drying Over Rigid Arms, abbreviated as "SECADORA".

SECADORA is a drying system comprised of at least one SECADORA electricity-free drying hanger. Each electricity-free drying hanger is typically comprised of a hub structure adapted to removably receive at least two separation arms. Separation arms are easily grasped and rapidly disengaged from the hub. Separation arms removably connect to the central hub, whereby when the arms are in the active-use position, clothing can be enrobed over the electricity-free drying hanger to promote air flow through the garment. Separation arms removably connect to the central hub, whereby when the arms are in the storage position, the unit is self-contained to prevent loss of arms. The hub comprises a swivel base for a hanging support to allow the electricity-free drying hanger to be removably mounted in any desired area. The swivel enables the electricity-free drying hanger to rotate to orient the electricity-free drying hanger as the user desires when mounted. Further, a protrusion from the hub allows an additional electricity-free drying hanger to removably nest into the initial electricity-free drying hanger. Accessories such as pins, clips or additional protrusions may be included as part of the electricity-free drying hanger, any of each may be integral or removably connected to the electricity-free drying hanger during both storage and use.

Each electricity-free drying hanger can include a hub structure adapted to receive two or more hollow at least two arms 20 which extend through the sleeves, of the garment, thereby separating the inner surfaces of sleeves and isolate other areas of the garment to maximize air flow through the garment. When the garment is sleeveless, the arms extend through the openings where the sleeves would be attached.

The tubular support arms are easily grasped and rapidly disengaged from the hub component in a single movement to rapidly hang each garment in a single repetitive action, inserting multiple support arms to hang a large number of shirts and dresses for air-drying in the shortest amount of time with minimal movement or exertion. Each SECADORA unit comprised of approximately three durable components, each of which may be affixed at one of two attachment points to position the device for use and storage.

In various embodiments, the term SECADORA may be a system comprised one or more individual SECADORA electricity-free drying hangers. Each electricity-free drying hanger includes a hub structure which is structurally adapted to receive two or more hollow at least two arms 20 which separate the inner surfaces of sleeves to maximize air flow.

In one aspect of the disclosure, an electricity-free apparel drying hanger comprises a hub, at least two arms, and a hanging support, the hub comprises at least two upper mounting apertures, at least two lower mounting apertures, a back wall, a front face, a first side wall, and a second side wall, the hub being configured to releasably secure the at least two arms in the at least two upper mounting apertures when the drying hanger is in use, the hub being configured to releasably secure the at least two arms in the at least two lower mounting apertures when the drying hanger is to be stored or not used, the at least two upper mounting apertures comprising a first upper mounting aperture and a second upper mounting aperture, the at least two lower mounting apertures comprising a first lower mounting aperture and a second lower mounting aperture, the first lower mounting aperture comprising a first lower arm support ramp extending outwardly from the first side wall of the hub and into a central cavity of the first lower mounting aperture, the second lower mounting aperture comprising a second lower arm support ramp extending outwardly from the second side wall of the hub and into a central cavity of the second lower mounting aperture, the first lower arm support ramp secures the first separation arm in the cavity of the first lower mounting aperture by incline plane force and the second arm support ramp secures the second separation arm in the second mounting aperture by incline plane force.

In an aspect of the present disclosure, the electricity-free drying hanger can be configured to easily receive, secure, and rapidly disengage the at least two arms from the at least two upper mounting apertures and are easily graspable and rapidly disengage able from the hub.

In an aspect of the present disclosure, the electricity-free drying hanger can comprise a hanging support that can be a hook engaged to an upper portion of the hub.

In an aspect of the present disclosure, the hub can comprise a mounting assembly and swivel mount in an upper portion of the hub for engaging the hanging support. The swivel mount can allow the hanging support to swivel when the hanging support is engaged with the hub.

In an aspect of the present disclosure, at least two lower mounting apertures can be adapted to receive and secure one of the at least two arms in substantially vertical position.

In an aspect of the present disclosure, the first upper mounting aperture can comprise a first arm support ramp for securing one of the at least two arms in the first upper mounting aperture by incline plane force.

In an aspect of the present disclosure, the second upper mounting aperture can comprise a second arm support ramp for securing one of the at least two arms in the second upper mounting aperture by incline plane force.

In an aspect of the present disclosure, an upwardly hooked protrusion can be incorporated into the hanger and extend outwardly from the front face.

In an aspect of the present disclosure, a system for drying garments can comprise at least two electricity-free drying hangers of claim 8, whereby the hanging support of one of the at least two electricity-free drying hanger is hung on the protrusion the other of the at least two electricity-free drying hangers to form a cascading system of electricity-free drying hangers.

In an aspect of the present disclosure, an electricity-free apparel drying device can comprise a drying hanger comprising a hub, at least two arms, and a hanging support, the hub comprises at least two upper mounting apertures each comprising an arm support ramp, at least two lower mounting apertures each comprising a lower arm support ramp, a hanging support, a swivel base for engaging the hanging support to the hub a back wall, a first side wall, a second side wall, and a front face, the hub being configured to releasably receive the at least two separation arms in the at least two upper mounting apertures for active-use, wherein the at least two separation arms are held in a substantially horizontal position by the at least two upper mounting apertures, the hub being configured to releasably receive the at least two separation arms in the at least two lower mounting apertures for storage of the at least two separation arms, wherein the at least two separation arms are held in a substantially vertical position by the at least two lower mounting apertures, the at least two upper mounting apertures comprising a first upper mounting aperture and a second upper mounting aperture, the first upper mounting aperture comprising a first support ramp extending forwardly from a back wall of the hub and into a central cavity of the first upper mounting aperture, the second upper mounting aperture comprising a second support ramp extending forwardly from the back wall of the hub and into a central cavity of the second upper mounting aperture, wherein the first arm support ramp secures one of the at least two arms inside the first upper mounting aperture by pressing one of the at least two arms forward and against a back side of the first upper mounting aperture and the second arm support ramp secures the second separation arm in the second mounting aperture by pressing one of the at least two arms forward and against a back side of the second upper mounting aperture.

In an aspect of the present disclosure, the at least two arms can comprise a first arm segment and a second arm segment.

In an aspect of the present disclosure, the first arm segment can be coupled to the second arm segment by a connector.

In an aspect of the present disclosure, the arms can be rigidly flexible and allow a user to bend them to a desired shape.

In an aspect of the present disclosure, a sleeve comprising a central opening and clips affixed to the outside of the sleeve, and one of the at least two arms can be inserted into the central opening of the sleeve.

In an aspect of the present disclosure, a clip can be releasably affixed to at least one of the at least two arms, wherein the clip secures clothing or fabric to the electricity-free drying hanger.

In an aspect of the present disclosure, each of the at least two arms can comprise a cap for capping a proximal end of at least one of the at least two arms.

In an aspect of the present disclosure, a method for air drying clothing and fabric can comprise the steps of forming a drying electricity-free drying hanger by inserting one of at least two arms into one of at least two upper mounting apertures in a hub, inserting the other of at least two arms into the other of at least two upper mounting apertures in the hub, hanging the electricity-free drying hanger from a surface by a hanging support engaged to the hub.

In an aspect of the present disclosure, hanging a second electricity-free drying can be performed by hanging the hanging support of the hanger from a hooked protrusion extending outwardly from a front face of the hub from a first hanger to form a cascading configuration of electricity-free drying hangers.

In an aspect of the present disclosure, at least one of the at least two arms can be inserted into a sleeve comprising clips affixed to the sleeve.

In an aspect of the present disclosure, a clip can be releasably attached to at least one of the at least two arms, wherein the clip secures clothing or fabric on the electricity-free drying hanger.

These and other objects, features, and advantages of the present disclosure will become more readily apparent from the attached drawings and the detailed description of the preferred embodiments, which follow.

BRIEF DESCRIPTION OF THE DRAWINGS

The present embodiments of the disclosure will hereinafter be described in conjunction with the appended drawings provided to illustrate and not to limit the disclosure, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the disclosure as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Terms of Art

As used herein, the term "aeration" means the process of removing odors or treating clothing with air, gas or chemical solvent.

As used herein, the term "apparel" means articles of clothing having openings or sleeves to accommodate arms such as shirts and dresses.

As used herein the term "air-drying" means drying a garment by exposure to ambient air rather than using mechanical means to dry the garment.

As used in herein the term "cascading structure" means having one frame removably mounted on a second frame with the possibility of either frame being mounted on a third or further frames.

As used herein, the term "dry-cleaning" means the process of removing odors or to treat clothing with air, gas or chemical solvent.

Figure 1A:
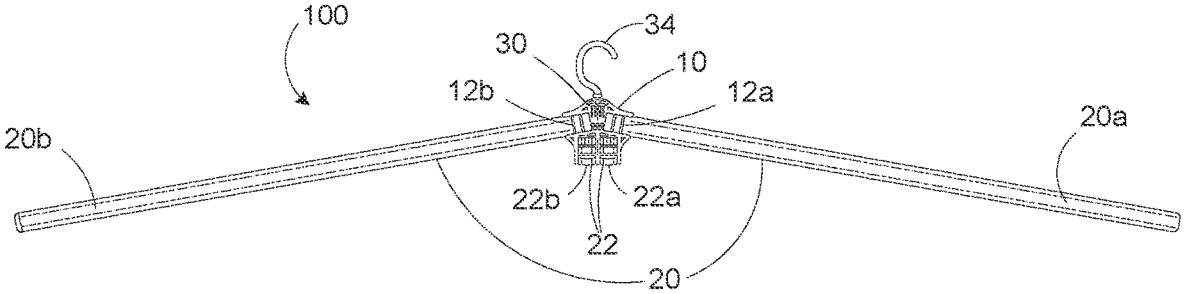
FIG. 1*a* shows a front view of at least one embodiment of the present disclosure illustrating an assembled electricity-free drying hanger, particularly illustrating the electricity-free drying hanger with the at least two arms in the use position.

FIG. 1*a* illustrates an exemplary embodiment of an electricity-free drying hanger 100, hereinafter hanger 100, comprising hub 10, hanging support 34, and at least two arms 20. The at least two arms 20 comprise a first arm 20*a* and a second arm 20*b*.

Figure 1B:
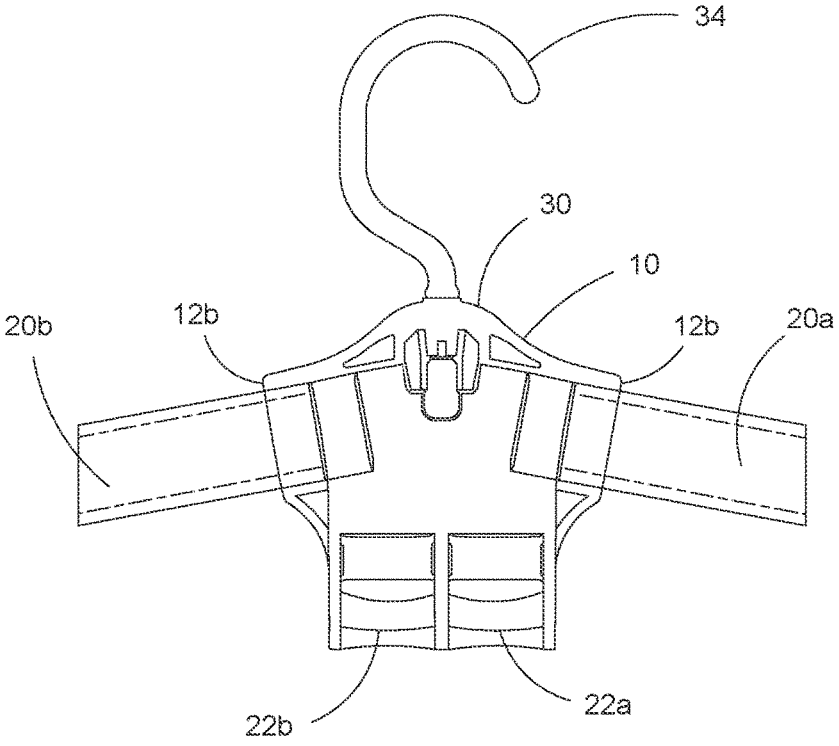
FIG. 1*b* shows a front plain view at least one embodiment of the present disclosure illustrating of a zoomed-in view of the hub in FIG. 1*a* and with the arms in the use position.

FIG. 1*b* illustrates an exemplary embodiment of how the at least two arms 20 mate to the hub 10. In an alternative embodiment, pins, clips or other pressure devices can be used to ensure clothing, garments, fabric, or other items that are to be air-dried stay securely mounted or connected to the hanger 100. The at least two arms 20 can be solid, hollow, tubular, crescent or shoe horned shape, have wiffleball style holes for increased aeration, varying symmetrical or asymmetrical dimensions, curved or non-linear, possess non-slip properties, and other similar features. This disclosure is not intended to be limited by the style or shape of the arm unless otherwise claimed. The at least two arms 20 could be hollow to direct air or other fluids that are humidity and thermally regulated through the device and toward the clothing.

In the exemplary embodiment shown in FIGS. 1*a* and 1*b*, hanger 100 can comprise a hub 10, a back wall 16, a front face 18, at least two arms 20, and a hanging support 34. The at least two arms 20 comprise a first arm 20*a* and a second arm 20*b*. Hub 10 comprises at least two upper mounting apertures 12, each being configured to engage one of the at least two arms 20. The at least two upper mounting apertures comprise a first upper mounting aperture 12*a* and a second upper mounting aperture 12*b* for positioning the at least two arms 20 in a substantially horizontal position to allow a garment with sleeves to be hung on the hanger 100. The first arm 20*a* and a second arm 20*b* can be at an oblique angle when hanger 100 is in use and lower mounting apertures 22*a* and 22*b* to position first arm 20*a* and the second arm 20*b* in a vertical storage position on hanger 100.

The at least two arms 20, a first arm 20*a* and a second arm 20*b* can be ridged in one embodiment. In another embodiment, the first arm 20*a* and second arm 20*b* can be rigidly flexible and allow a user to bend them to a desired shape to separate the inner surfaces of garment sleeves to maximize air flow throughout the garment.

FIG. 1*b* illustrates at least one exemplary embodiment of the hanger 100 of FIG. 1*a* positioned for use with a garment, with the first arm 20*a* and the second arm 20*b* inserted into upper mounting apertures 12*a* and 12*b*. As shown, upper mounting apertures 12*a* and 12*b* can be used to position the first arm 20*a* at an oblique angle to the second arm 20*b* after the at least two arms 20 are inserted into a garment to air-dry and/or store the garment.

Figure 2A:
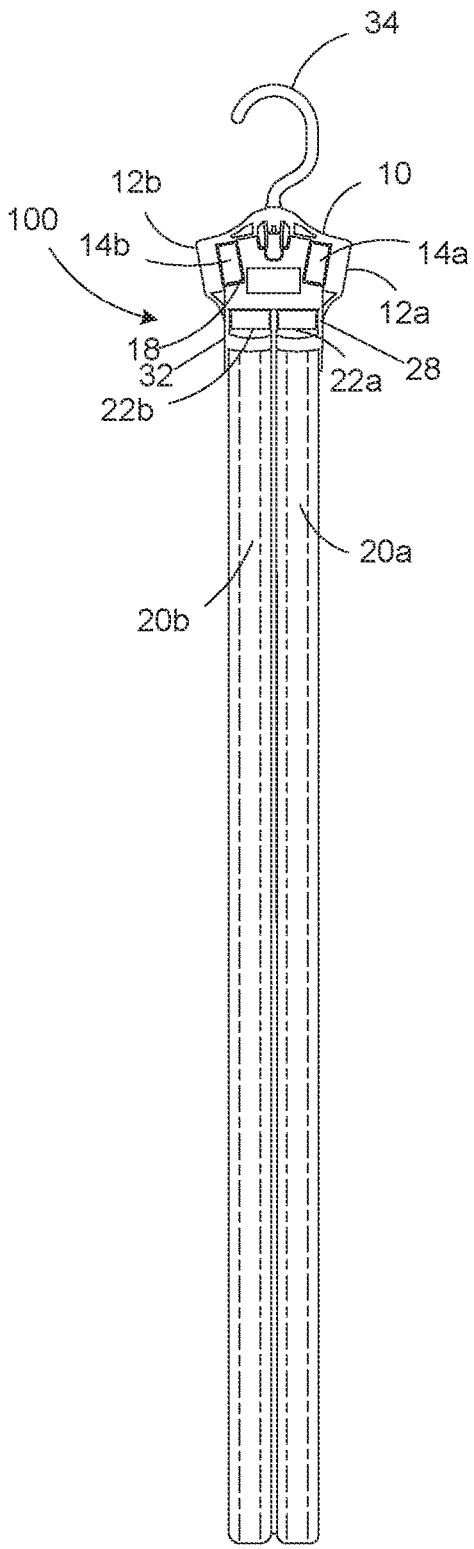
FIG. 2*a* shows a front view of one embodiment of the present disclosure illustrating the SECADORA in a collapsed position for storage.
Figure 2B:
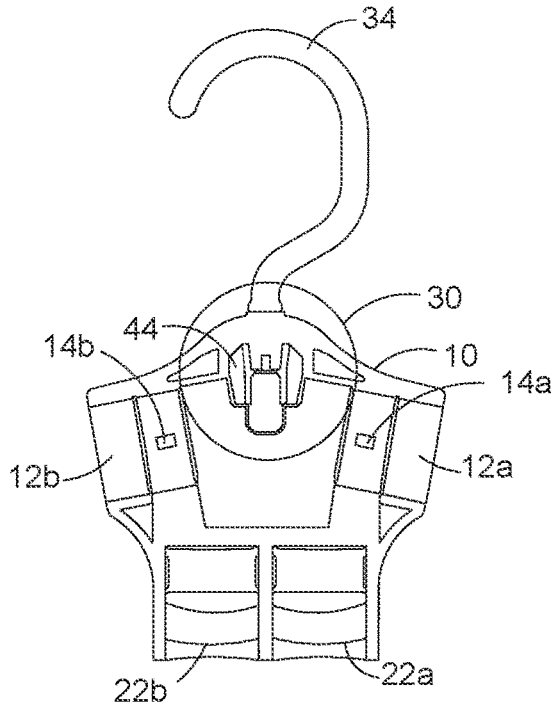
FIG. 2*b* is a front view of at least one embodiment of the present disclosure of the hub in detail.
Figure 2C:
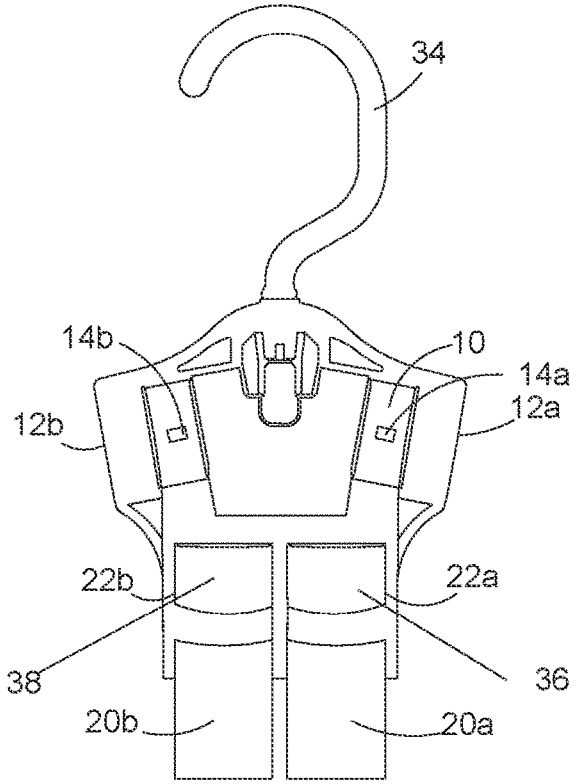
FIG. 2*c* is a zoomed-in view of the hub with arms collapsed for self-storage in close up.

FIG. 2*a-c* illustrate at least one exemplary embodiment of how the hanger 100 can be self-contained for storage. The at least two at least two arms 20, e.g., the first arm 20*a* and the second arm 20*b*, can each be attached to lower mounting apertures 22. As illustrated, the lower mounting apertures 22 can comprise a first lower mounting aperture 22*a* and a second lower mounting aperture 22*b* for storing the at least two at least two arms 20 in a substantially vertical position. The first arm 20*a* can be removably engaged within the first lower mounting aperture 20*a* and the second arm 20*b* can be removably mounted within the second lower aperture 22*b*. In an alternative embodiment, pins, clips or other pressure devices can be used to ensure the at least two arms 20 are securely mounted in a horizontal position when the hanger 100 is not in use.

hanger 100 can be easily assembled for use and disassembled for storage. The components can be stored apart or together by attaching the at least two at least two arms 20 to the lower mounting apertures 22. The first arm 20*a* can comprise a proximal end 36 that allows the first arm 20*a* to be removably engaged to the lower mounting aperture 22*a*. Proximal end 36 can be inserted into the lower mounting aperture 22*a* which allows the first arm 20*a* to be mounted in the hanger 100 and stored in a vertical position. The second arm 20*b* can comprise a proximal end 38 that allows the second arm 20*b* to be removably engaged to the lower mounting aperture 22*b*. Proximal end 38 can be inserted into the lower mounting aperture 22*b* which allows the second arm 20*b* to be mounted in the hanger 100 and stored in a vertical position.

Figure 3:
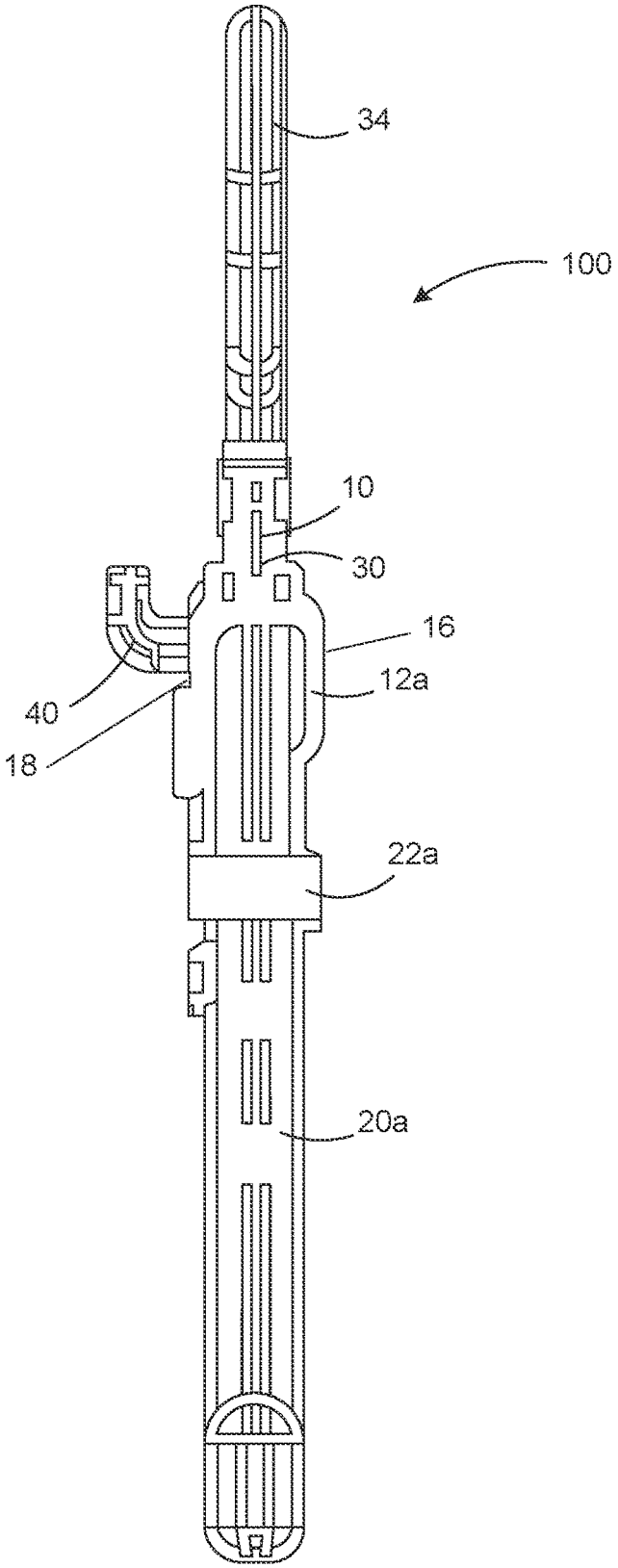
FIG. 3 shows a side view of at least one embodiment of the present disclosure illustrating the SECADORA unit assembly, specifically the nesting support structure is visible. The opposite side view would be a mirror image.

FIG. 3 illustrates at least one exemplary embodiment of the hub 10 comprising a mounting device 40 that can engage another hanger 100 hanging support 34. In this embodiment, the hanging support 34 can be a curved into a hook (better illustrated in FIG. 1) and the protrusion or mounting device 40 can be curved upwardly and be shaped as a hook. However, this disclosure is not intended to be limited to a specific shape for the hanging support 34 or the mounting device 40, and each can comprise alternative shapes or styles. Alternative embodiments can comprise a mounting device 40 permanently integrated into hub 10 as the hub is made, removably connected to hub 10, or created separately and then permanently connected to hub 10.

Exemplary embodiments of the first arm 20*a*, upper mounting aperture 12*a* and lower mounting aperture 22*a*, proximal end 36, second arm 20*b*, second upper mounting aperture 12*b*, lower mounting aperture 22*b* (hidden on the far side of the unit), and hub 10 comprising mounting assembly 30 can be seen in FIG. 3. Each hanger 100 unit can comprise a minimal number durable components and attachment points to minimize time and labor associated with air-drying garments, along with the complexity of disassembly for storage.

In the exemplary embodiment shown, at least two arms 20 can be easily grasped and disengaged from hub 10 in a single movement. The proximal end 36 of the at least two arms 20 can be easily engaged into the lower mounting apertures 22 to save horizontal space when storing the hanger 100. The at least two arms 20 can easily be grasped and engaged into the upper mounting apertures 12 in the hub 10 to hang a garment, or a large number of garments, such as shirts and dresses, for air-drying in the shortest amount of time with the minimal movement or exertion.

Hub 10 includes a fixedly attached structure to attach hanger 100 to an external structure by use of a hanging support 34 which may be attached to hub 10 by mounting assembly 30. Various embodiments of hanging support include hooks, plates, bolts, clamps, interlocking components, fitted components, spring activate components, and rings. As shown, hanging support 34 can be a hook disposed at the upper edge of hub 10 for selectively hanging each unit to an external support structure, or to a protrusion or mounting device 40 on another hub 10. In various embodiments, the mounting hook may be integrally molded, movably or pivotally attached. In various embodiments components, mounting hook may be compromised of rounded or flattened surfaces, and may include a separation plate or surface so that clothing does not touch a door or other adjacent surface during drying.

Figure 4:
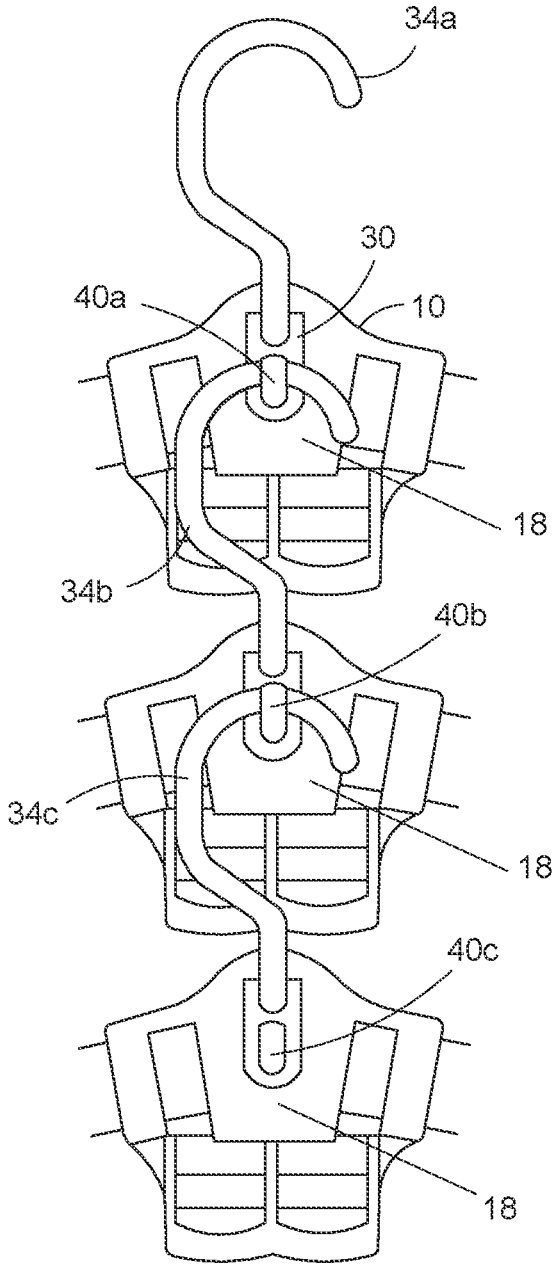
FIG. 4 shows a front partial view of at least one embodiment of the present disclosure illustrating three electricity-free drying hangers nested during systemic use.

In FIG. 4, the hub 10 comprises a mounting device 40 that can be a protuberance used to join or hang other hanger 100 devices in a cascading or nesting configuration. Here, three hanger 100 devices are hung or stored together, where the second unit can be hung off of the first unit's mounting device 40*a*, by its hanging support 34*b*, and the third unit can be hung off of the second units mounting device 40*b* by its hanging support 34*c*. As shown, the hanger 100 devices can be arranged into a cascading configuration and capable of being hung in a closet or on a door by hanging support 34*a* to maximize use of horizontal space required for air drying garments.

As illustrated, hanger 100 may be utilized as a system comprised of a single SECADORA unit or may be configured to include to include multiple, modularly attached units which are affixed to a single external structure in a novel cascading configuration for air-drying and aeration using a mounting assembly 30. The cascading configuration minimizes the amount of horizontal space that is required and allows the SECADORA to mounted flush to a door frame in a bedroom or other area of the home where clothes are traditionally stored. The SECADORA can comprise air discharge holes to expedite drying time.

Figure 5:
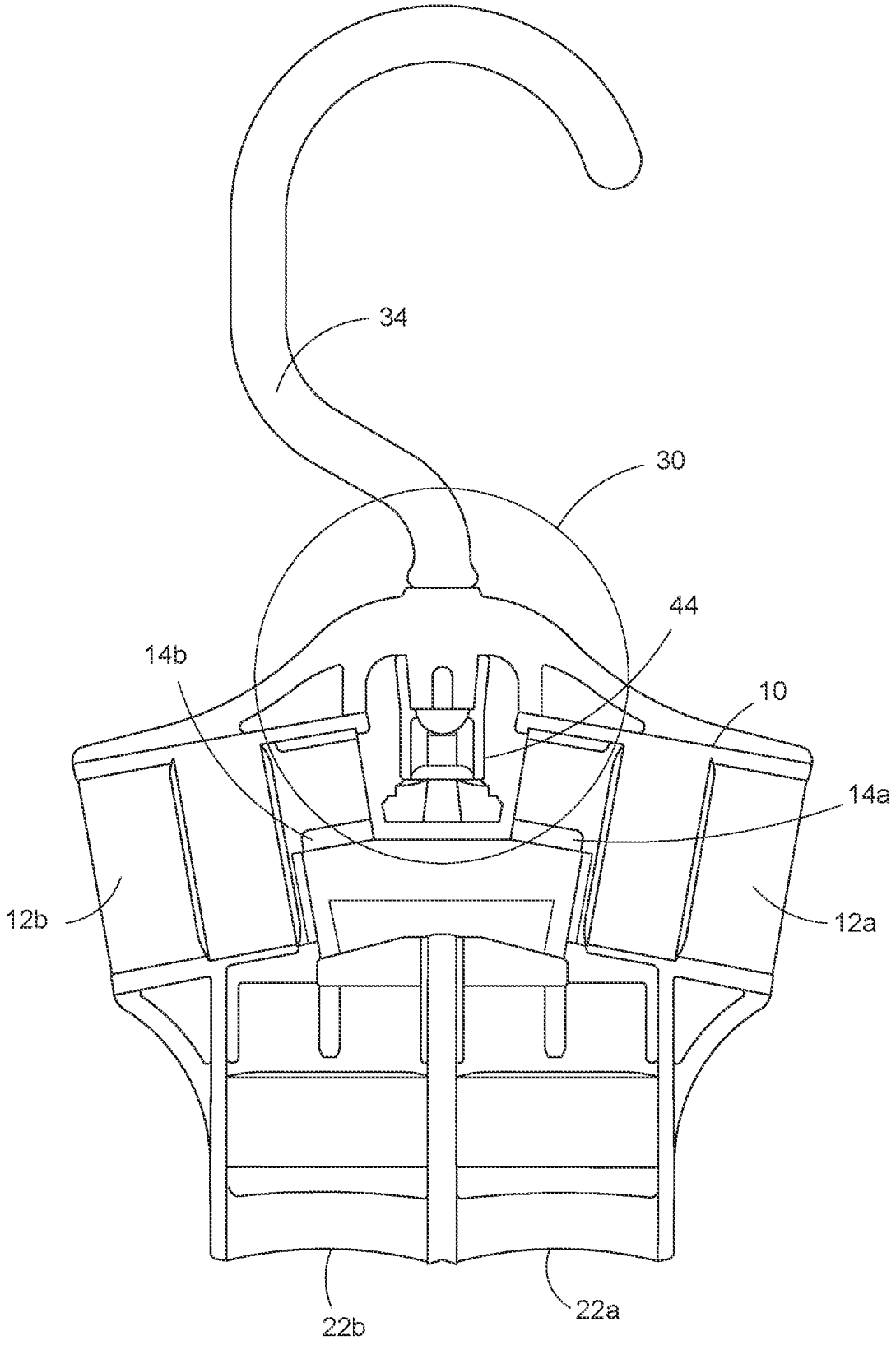
FIG. 5 shows a rear view of at least one embodiment of the present disclosure illustrating the hub without an arm inserted.

FIG. 5 is the rear view of the hub. The rear of the swivel mount 44 can be seen in mounting assembly 30, attached to hanging support 34 so that is can rotate about vertical axis 46 (see FIG. 6*b*) of swivel mount 44.

Figure 6A:
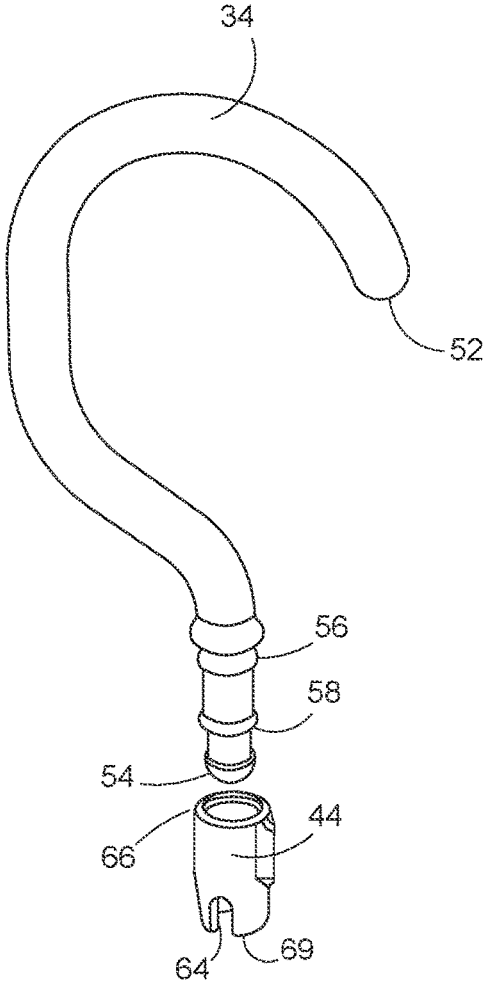
FIG. 6*a-c* shows details of at least one embodiment of the present disclosure illustrating the pivot and mounting assembly for a hanging support illustrated as a hook.
Figure 6B:
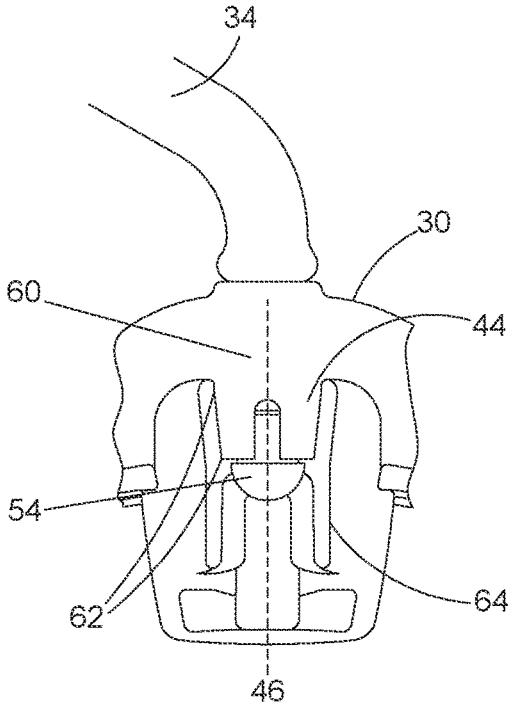
Figure 6C:
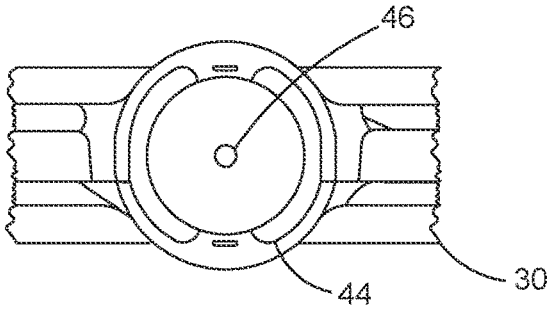

FIGS. 6*a*-6*c* illustrate at least one embodiment of a swivel mount 44 and mounting assembly 30 for a hanging support 34. The hanging support 34 can be engaged with an upper portion of the hanger 100 and pivotable in its mounting. The hanging support 34 can also be permanently engaged to the swivel mount 44. The hanging support 34 can be a hook, a closed loop, or any shape that can be used to hang the hanger 100 on a surface. A distal end 52 can be configured to allow the hanger to hang from a rod or other surface. The hanging support 34 can comprise a proximal end 54 for engaging the swivel mount 44. The proximal end 54 of the hanging support 34 can comprise a plurality of protrusions 56 and 58, or more, for rigidly affixing the proximal end of the hook into swivel mount 44, where the swivel mount comprises complimentary recesses 62 for accepting the protrusions from the proximal end 54 of the hanging support. Herein, the base of the proximal end is larger than the cavity 64 inside the swivel mount for accepting the proximal end of the hanging support 34. The swivel mount 44 can comprise an upper end 66 that can flex to receive the base of the proximal end of the hanging support 34. FIG. 6*c* is a bottom end view of swivel mount 44 as part of mounting assembly 30.

Here, protrusions 56 and 58 at the proximal end of the hanging support 34 take the form of two rings that allow the hanging support 34 to engage the swivel mount 44 to firmly and rigidly while allowing the hanging support 34 to rotate freely inside the swivel mount. The at least two rings provide stability to the hanging support 34 and stop it from wobbling when the hanging support 34 is employed or is rotated. The hanging support 34 can be employed when it is used to hang the hanger 100 from a surface, such as a rod, ring, bar, or other surface that a hanging support 34 can be hung from a surface. The bottom of the proximal end 54 can be shaped as a half sphere and comprise a rim. The rim presses against the bottom end 69 of the swivel mount when the hanging support 34 inserted into the swivel mount. The proximal end of the hanging support 34 exits the bottom end 69 of the swivel mount 44 and presses against the bottom of the swivel mount when the hanging support 34 is engaged to the swivel mount 44. The bottom end 69 of the swivel mount 44 can comprise at least two notches 65 that can split the distal end into two fingers. As proximal end 54, which can be shaped as a half-sphere, is pushed through the swivel mount 44, the fingers can flex to allow the base of the proximal end that is larger than the cavity of the swivel mount 44 to enter the cavity and exit the bottom end 69 of the swivel mount 44.

Figure 7A:
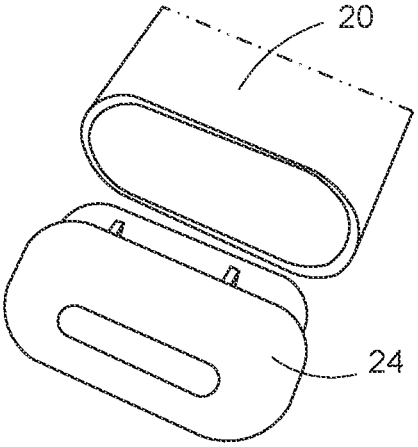
FIG. 7*a*-7*b* illustrates at least one embodiment of the present disclosure illustrating the arm end caps.
Figure 7B:
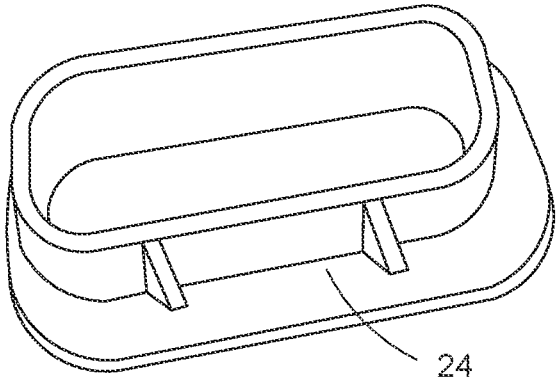

FIGS. 7*a*-7*b* illustrate at least one embodiment of caps 24 that can be inserted into the distal ends of the at least two arms 20 comprising a hollow, mostly hollow, or somewhat hollow interior. The interior of the at least two arms may comprise support structures and the support structures may allow air to flow through the two arms 20.

Figure 8:
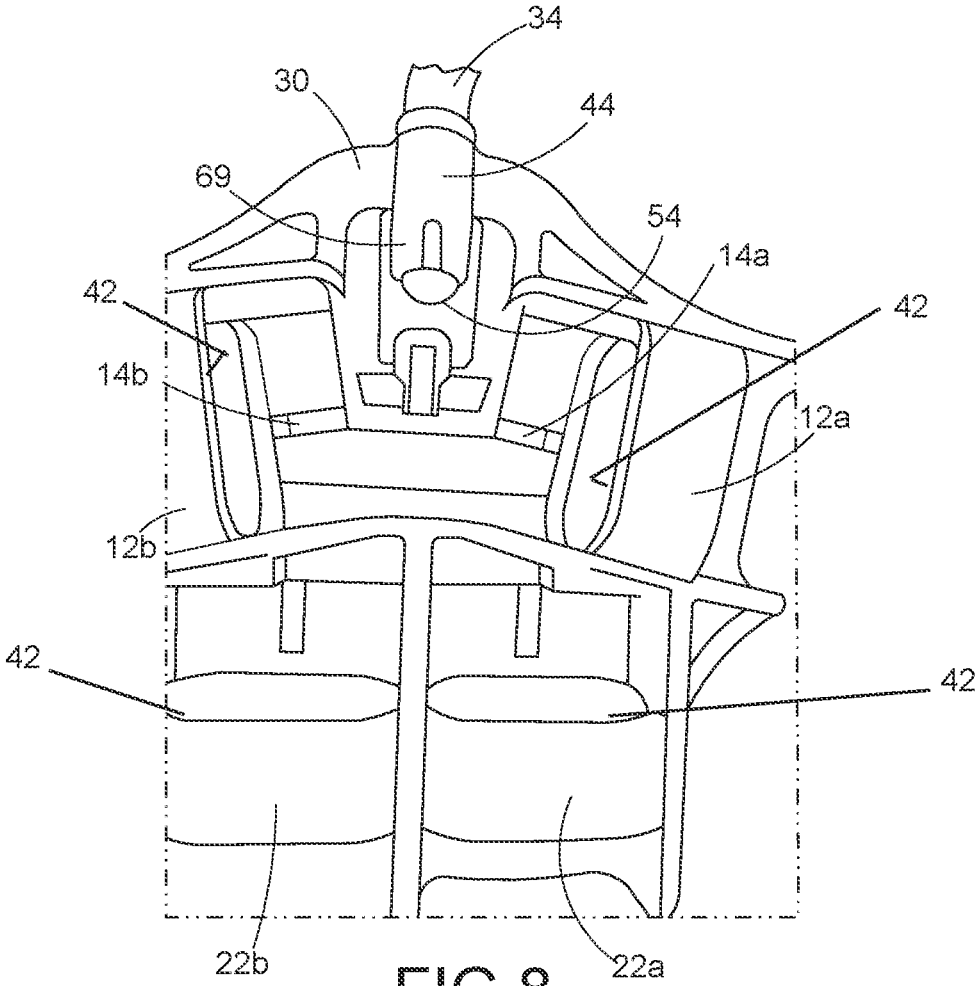
FIG. 8 shows at least one embodiment of the inside of the frame with the arm support ramps pointed to by a knife and the proximal end of the hanging support through the swivel mount.

FIG. 8 illustrates at least one embodiment of the frame comprising at least one arm support ramp, e.g., a first arm support ramp 14*a* and a second arm support ramp 14*b* in each upper mounting aperture 12*a* and 12*b*. The arm support ramp increases in thickness from the outside of the hub, e.g., first side 28 and second side 32, to the inside of the hub. The first arm support ramp 14*a* presses against an end of one of the at least two arms 20 as it is inserted into the first upper mounting aperture 12*a* and provides increasing pressure against a proximal end 36 of the arm due to the increasing pressure the first arm support ramp places on the proximal end 36, thereby pressing the proximal end 36 forward and against a back side 42 of the apertures 12 and 22 and securing the first arm 20*a* in the first upper mounting aperture 14*a*. The second arm support ramp 14*b* operates the same way as the first arm support ramp 14*a*. Thus, the arm support ramps help lock the farms in place when it is inserted into the mounting apertures. Similar arm support ramps can also be found in lower mounting apertures 22*a* and 22*b*.

Generally, the first arm support ramp 14*a* and the second arm support ramp 14*b* are inclined planes comprising a flat supporting surface tilted at an angle, with one end higher than the other, used as an aid for increasing normal force against the proximal ends 36 and 38 to overcome the force of gravity and secure the at least two arms 20 in the hub 10. The normal force presses the proximal ends 36 and 38 into the back side 42 of the upper mounting apertures 12 and 22. The inclined plane is a classical simple machine.

Figure 9A:
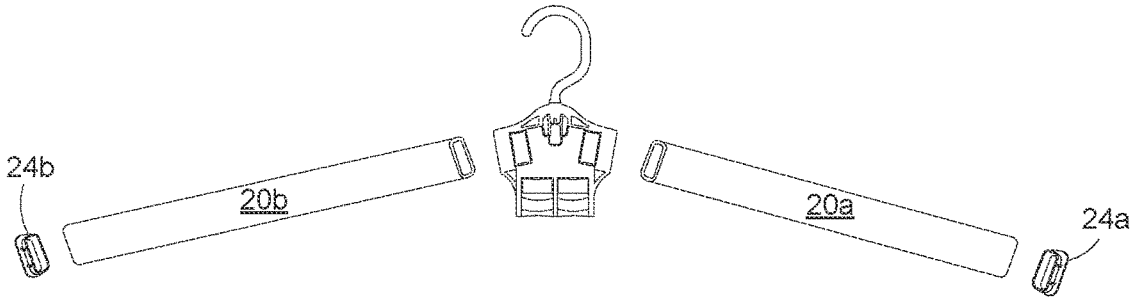
FIG. 9*a*-9*c* illustrates several embodiments of the invention whereby the arms have varying lengths and can be connected to each other to increase the length of the arms.
Figure 9B:
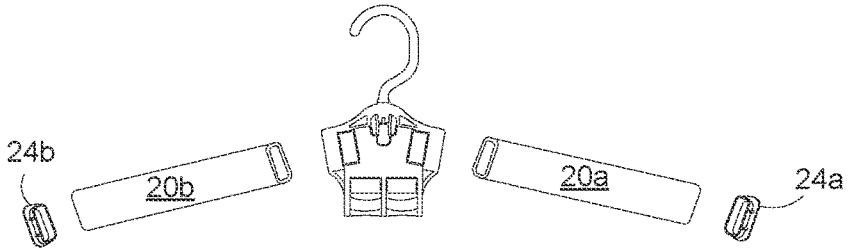
Figure 9C:
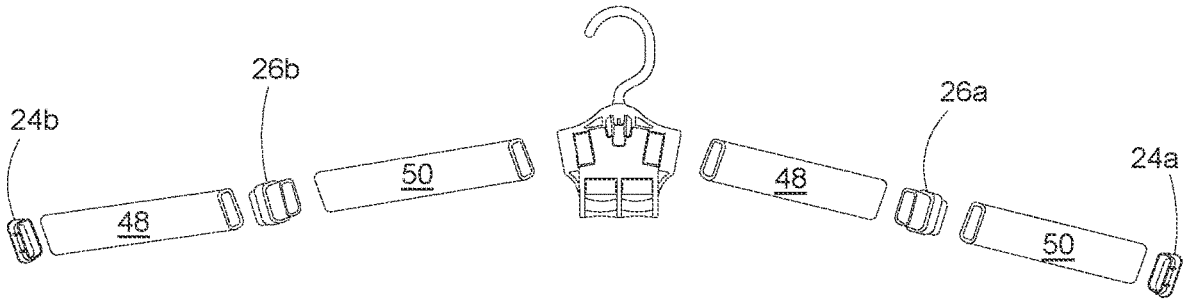

First arm 20*a* and second arm 20*b* may be of alternate lengths in various embodiments as shown in FIGS. 9*a*-9*c*. As shown, first arm 20*a* and second arm 20*b* can comprise end caps 24*a* and 24*b* respectively, and in FIG. 9*c*, connectors 26 (shown as 26*a* and 26*b* for respective sides of the unit) can couple or connect multiple arm segments into a longer arm. As an example, a first arm segment 48 can be coupled to a second arm segment 50 by connector 26. More arm segments can be coupled to the coupled first arm segment 48 and second arm segment 50 to create longer arms.

Figure 10:
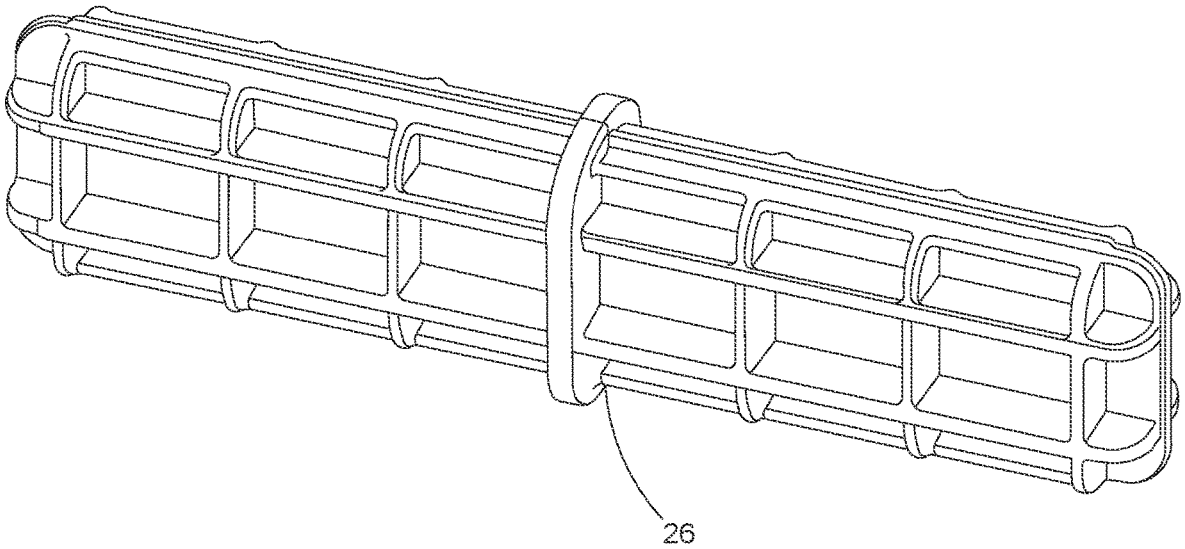
FIG. 10 illustrates an embodiment of a connector in FIG. 9*c;*

FIG. 10 illustrates an exemplary embodiment of the connector 26 that couples arm segments together, as show in FIGS. 9*c* as 26*a* and 26*b*, connecting two sets of 20*a* and two 20*b* arms, respectively. The connectors can be formed in a manner which still allows air flow through the arms to facilitate drying, by either narrowing or ventilating blockages.

Generally, a user will pick up a garment by the shoulder and the opposite sleeve will hang down due to gravity (naturally hang straight down or vertically). The hub 10 is attached it a first arm 20*a*, and the user will side the first arm 20*a* into the sleeve of the garment that is hanging (opposite of the one grabbed). The second arm 20*b* is not attached to the hub when it is inserted into the garment. The user will grab the other shoulder of the garment that is connected to the sleeve that comprises the first arm 20*a* inserted into the sleeve. The user will slide second arm 20*b* into the second sleeve that is now hanging and insert the proximal end 38 of second arm 20*b* into the second mounting aperture 12*a*. The hanger 100 allows for quick and easy hanging of clothes, garments, fabrics, and other items.

In the exemplary embodiment shown, articles of apparel may be hung on multiple electricity-free drying hangers 100 by a simple, successive series of repetitive movements to detach and reattach one of the arms 20.

A first arm 20*a* can be secured to hub 10 prior to hanging the garment, and the second arm 20*b* can be reattached after the garment is mounted on the first arm 20*a*, or vice versa. This method facilitates rapid insertion of at least two arms 20 through the sleeves and/or arm openings of wet clothing, and expands and suspends the mounted garment in a position that is substantially vertical during the air-drying process to promote air flow and aeration.

Figure 11:
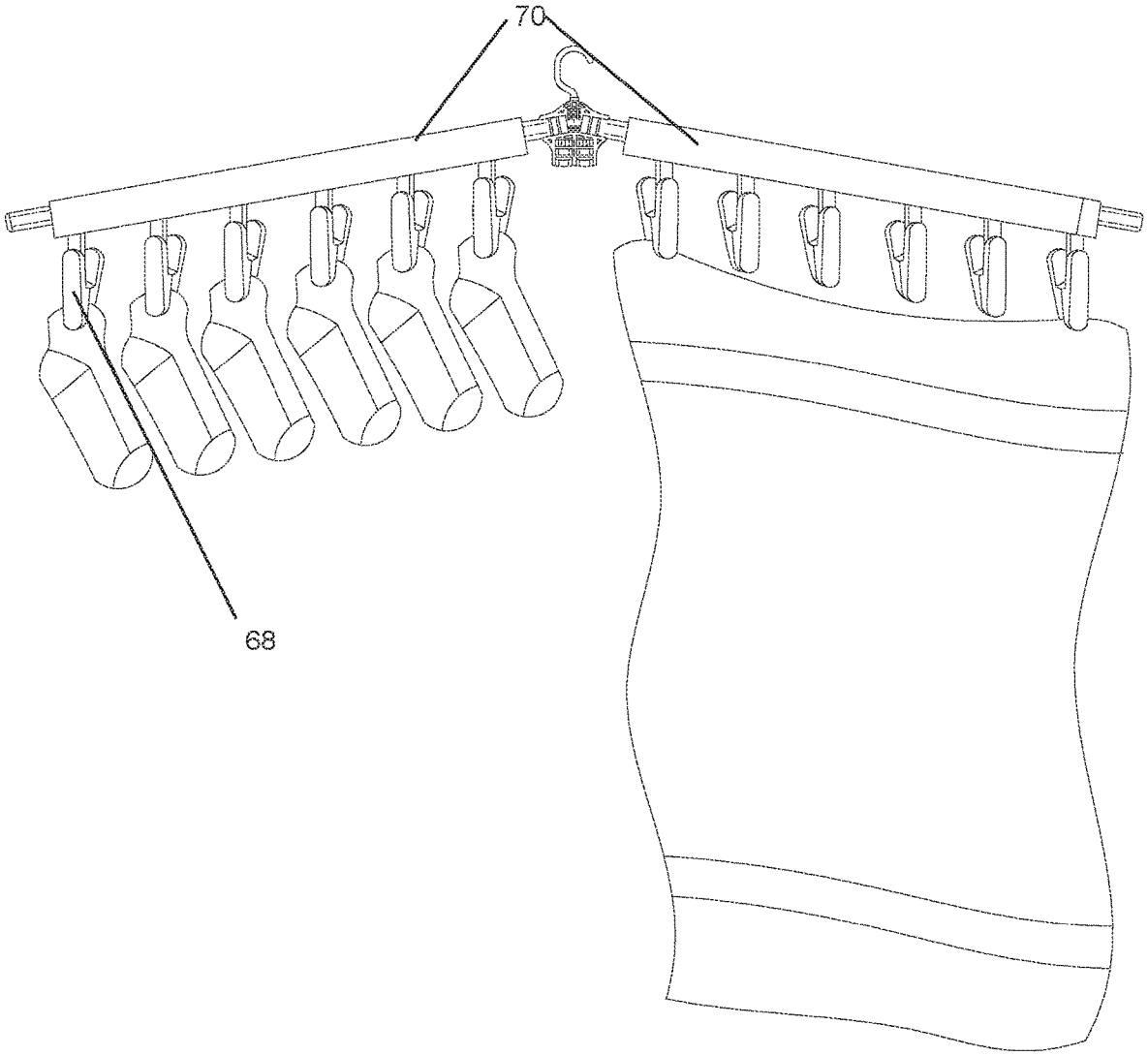
FIG. 11 illustrates an embodiment of the electricity free drying hanger comprising a sleeve of clips being disposed over at least one arm.
Figure 12:
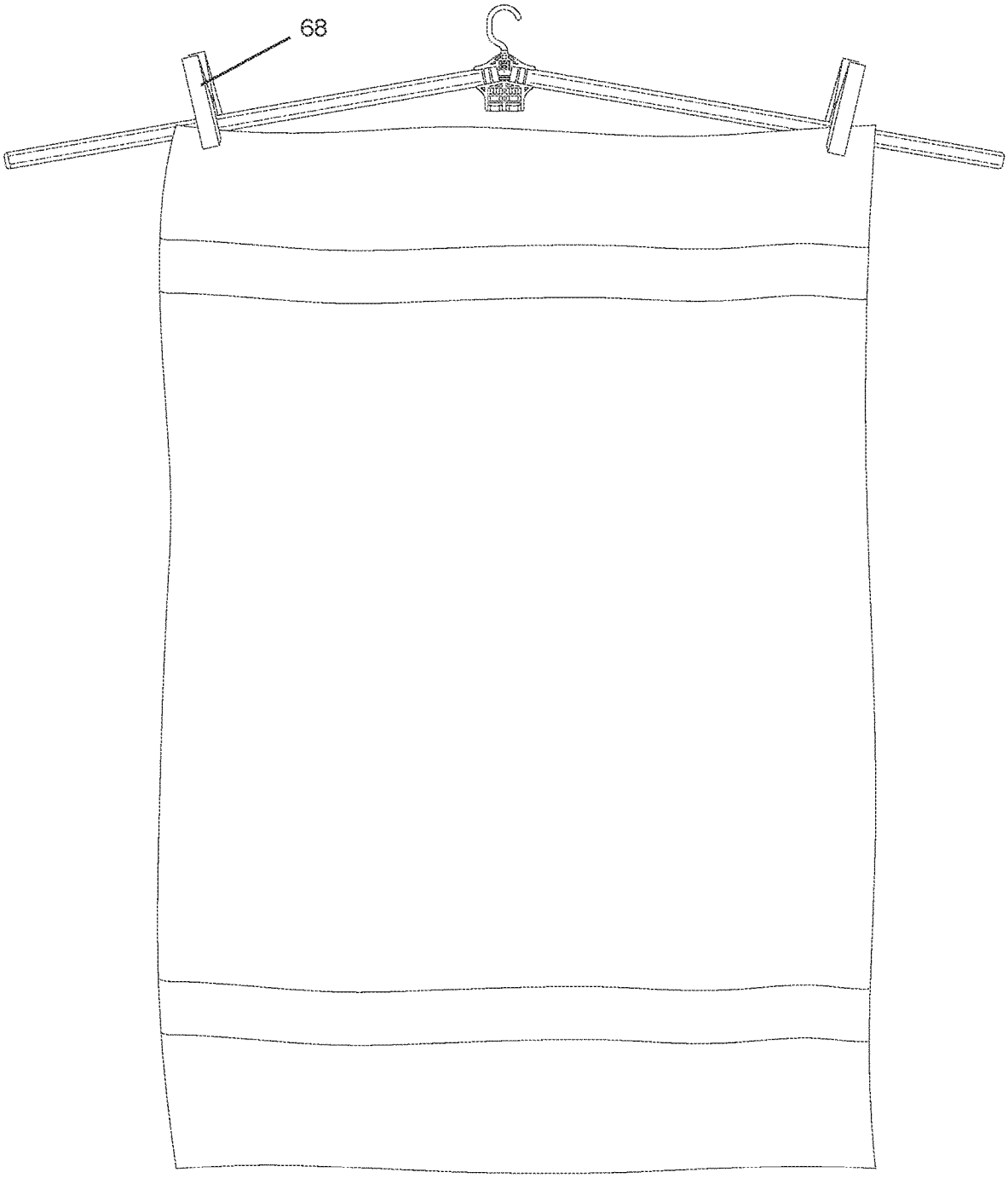
FIG. 12 illustrates an embodiment of the electricity-free drying hanger comprising a clip releasably clipped to at least one arm.

FIGS. 11 and 12 illustrate exemplary embodiments of employing fasteners or clips 68 to affix or secure clothes, garments, fabric, or any other item to the hanger 100. The clips 68 can be clipped directly to at least one of the at least two arms 20 or the clips 68 can be affixed to a sleeve 70 that is slid over at least one of the at least two arms 20.

Since many modifications, variations, and changes in detail can be made to the described preferred embodiments of the disclosure, it is intended that all matters in the foregoing description and shown in the accompanying drawings be interpreted as illustrative and not in a limiting sense. Thus, the scope of the disclosure should be determined by the appended claims and their legal equivalents.

What is claimed is:

1. An electricity-free drying hanger comprising:

a hub, at least two arms being a first arm and a second arm, and a hanging support;

the hub comprises at least two upper mounting apertures, at least two lower mounting apertures, a back wall, a front face, a first side wall, and a second side wall;

the hub being configured to releasably secure the at least two arms in the at least two upper mounting apertures when the electricity-free drying hanger is in use;

the hub being configured to releasably secure the at least two arms in the at least two lower mounting apertures when the electricity-free drying hanger is to be stored or not used;

the at least two upper mounting apertures comprising a first upper mounting aperture and a second upper mounting aperture;

the at least two lower mounting apertures comprising a first lower mounting aperture and a second lower mounting aperture;

the first lower mounting aperture comprising a first lower arm support ramp extending outwardly from the first side wall of the hub and into a central cavity of the first lower mounting aperture;

the second lower mounting aperture comprising a second lower arm support ramp extending outwardly from the second side wall of the hub and into a central cavity of the second lower mounting aperture; and the first lower arm support ramp secures the first arm in a cavity of the first lower mounting aperture by incline plane force and the second arm support ramp secures the second arm in the second mounting aperture by incline plane force.

2. The electricity-free drying hanger of claim 1, wherein the electricity-free drying hanger is configured to easily receive, secure, and rapidly disengage the at least two arms from the at least two upper mounting apertures and are easily graspable and rapidly disengage able from the hub.

3. The electricity-free drying hanger of claim 1, wherein the hanging support is a hook engaged to an upper portion of the hub.

4. The electricity-free drying hanger of claim 1, wherein the hub further comprises a mounting assembly and swivel mount in an upper portion of the hub for engaging the hanging support, wherein the swivel mount allows the hanging support to swivel when the hanging support is engaged with the hub.

5. The electricity-free drying hanger of claim 1, wherein each of the at least two lower mounting apertures are adapted to receive and secure one of the at least two arms in substantially vertical position.

6. The electricity-free drying hanger of claim 1, wherein the first upper mounting aperture further comprises a first arm support ramp for securing one of the at least two arms in the first upper mounting aperture by incline plane force.

7. The electricity-free drying hanger of claim 1, wherein the second upper mounting aperture further comprises a second arm support ramp for securing one of the at least two arms in the second upper mounting aperture by incline plane force.

8. The electricity-free drying hanger of claim 1, further comprising an upwardly hooked protrusion extending outwardly from the front face.

9. A system for drying garments, the system comprising at least two electricity-free drying hangers of claim 8, whereby the hanging support of one of the at least two electricity-free drying hanger is hung on the protrusion the other of the at least two electricity-free drying hangers to form a cascading system of electricity-free drying hangers.

10. An electricity-free apparel drying device comprising:

a drying hanger comprising a hub, at least two arms, and a hanging support;

the hub comprises at least two upper mounting apertures each comprising an arm support ramp, at least two lower mounting apertures each comprising a lower arm support ramp, a hanging support, a swivel base for engaging the hanging support to the hub a back wall, a first side wall, a second side wall, and a front face;

the hub being configured to releasably receive the at least two arms in the at least two upper mounting apertures for active-use, wherein the at least two arms are held in a substantially horizontal position by the at least two upper mounting apertures;

the hub being configured to releasably receive the at least two arms in the at least two lower mounting apertures for storage of the at least two arms, wherein the at least two arms are held in a substantially vertical position by the at least two lower mounting apertures;

the at least two upper mounting apertures comprising a first upper mounting aperture and a second upper mounting aperture;

the first upper mounting aperture comprising a first support ramp extending forwardly from a back wall of the hub and into a central cavity of the first upper mounting aperture;

the second upper mounting aperture comprising a second support ramp extending forwardly from the back wall of the hub and into a central cavity of the second upper mounting aperture;

wherein the first arm support ramp secures one of the at least two arms inside the first upper mounting aperture by pressing one of the at least two arms forward and against a back side of the first upper mounting aperture and a second arm support ramp secures the second arm in the second mounting aperture by pressing one of the at least two arms forward and against a back side of the second upper mounting aperture.

11. The electricity-free drying hanger of claim 10, wherein said at least two arms comprise a first arm segment and a second arm segment.

12. The electricity-free drying hanger of claim 11, wherein the first arm segment is coupled to the second arm segment by a connector.

13. The electricity-free drying hanger of claim 12, wherein the each of the at least two arms further comprises a cap for capping a proximal end of at least one of the at least two arms.

14. The electricity-free drying hanger of claim 10, wherein the arms are rigidly flexible and allow a user to bend them to a desired shape.

15. The electricity-free drying hanger of claim 10, further comprising a sleeve comprising a central opening and clips affixed to an outer portion of the sleeve, wherein one of the at least two arms is inserted into the central opening of the sleeve.

16. The electricity-free drying hanger of claim 10, further comprising a clip releasably affixed to at least one of the at least two arms, wherein the clip secures clothing or fabric to the electricity-free drying hanger.

17. A system for air drying garments comprising:

at least two hangers;

each hanger comprising:

a hub having at least two upper mounting apertures and at least two lower mounting apertures;

a pair of support arms, being each removably coupled to the upper mounting apertures in an extended position and to the lower mounting apertures in a collapsed position;

a hanging support rotatably engaged with the hub; and a protrusion extending from the hub for nesting two of said at least two hangers in a cascading configuration, wherein each upper mounting aperture comprises a support ramp extending forwardly from a back wall of the hub into a central cavity of the upper mounting aperture and each lower mounting aperture comprises a lower arm support ramp extending from a side wall of the hub into a central cavity of the lower mounting aperture so that the system is configured to perform a method of drying garments, the method comprising:

suspending a garment over the support arms to maximize surface area exposure to airflow;

allowing air to pass through the garment via the support arms;

rotating the hanging support to optimize air exposure based on environmental conditions; and collapsing the support arms for compact storage after garment drying is completed.

* * * * *